United States Patent [19]

Zablocky

[11] 4,324,523

[45] Apr. 13, 1982

[54] SYSTEM FOR HANDLING TUBULAR CONTAINERS, INCLUDING APPARATUS AND CASES THEREFOR

[76] Inventor: William J. Zablocky, 312 Myers Ave., Hasbrouck Heights, N.J. 07604

[21] Appl. No.: 143,914

[22] Filed: Apr. 25, 1980

[51] Int. Cl.[3] ..... B65B 69/00

[52] U.S. Cl. ..... 414/131; 206/277; 206/443; 221/197; 221/268; 229/17 B; 414/417

[58] Field of Search ..... 414/115, 125, 131, 413, 414/416, 417; 221/88, 197, 198, 268; 229/17 B, 17 SC, 7 SC; 206/44.12, 277, 443; 312/45, 71, 72, 73

[56] References Cited

U.S. PATENT DOCUMENTS

| | | | |
|---|---|---|---|
| 1,194,372 | 8/1916 | Fischer | 206/44.12 |
| 2,686,604 | 8/1954 | Cameron et al. | 221/197 X |
| 2,940,636 | 6/1960 | Pechy | 221/198 X |
| 3,072,273 | 1/1963 | Foster, Sr. et al. | 414/417 |

FOREIGN PATENT DOCUMENTS

| | | | |
|---|---|---|---|
| 1215247 | 4/1960 | France | 414/125 |
| 2451318 | 11/1980 | France | 414/417 |
| 805637 | 12/1958 | United Kingdom | 414/131 |

*Primary Examiner*—Leslie J. Paperner
*Attorney, Agent, or Firm*—Samuelson & Jacob

[57] ABSTRACT

A system for handling tubular containers includes apparatus for unloading the tubular containers from incoming cases within which the tubular containers are arranged in freely stacked rows, the apparatus including a pusher member for engaging the exterior of each container in a row of tubular containers and pushing the tubular containers from each case in row-by-row sequence at a level elevated relative to a selected delivery point, and a delivery ramp for receiving the pushed rows of tubular containers and enabling the tubular containers to descend to the delivery point in appropriate order and alignment. The cases have a slot-like access opening for the pusher member and an opposite egress opening for allowing each row of tubular containers to emerge from the case in response to actuation of the pusher member.

10 Claims, 12 Drawing Figures

SYSTEM FOR HANDLING TUBULAR CONTAINERS, INCLUDING APPARATUS AND CASES THEREFOR

The present invention relates to the storage and transportation of containers within cases and to the unloading of the containers from the cases and pertains, more specifically, to a system which includes the construction of the cases and apparatus for unloading the cases in an ordered manner for further processing of the containers.

It is common in the manufacture and filling of containers to fabricate the containers at one location and then place the containers in cases for storage and eventual transport to a second location where the containers are unloaded from the cases for filling and closing. In particular, in the packaging of cosmetic and pharmaceutical products in collapsible tubular containers, such as in the marketing of toothpaste, creams, ointments and the like, the tubular containers or tubes usually are manufactured in one factory and then are placed in cases for transport to another facility where the tubes are unloaded from the cases and transferred to filling and closing machines.

Among the more common procedures utilized in unloading and transferring the tubes is one which includes reaching inside the tubes themselves, either manually or with finger-like devices, so as to frictionally engage the interior of each tube, and then pulling the engaged tubes from the cases. Usually, the tubes each are nested within a separate compartment formed by partitions in the case in order to isolate the tubes from one another and place each tube in a precise location within the case so as to facilitate accurate registration of the tubes with the finger-like devices used to withdraw the tubes from a case. The procedure thus has some drawbacks; including, a relatively complex case construction required in order to provide the separate nests, and the requirement that the interior of the tubes be engaged, thus introducing the possibility of damage or contamination of the interior of the tubes.

It is an object of the present invention to provide a simplified case construction for the storage, transport and transfer of tubular containers, such as collapsible tube containers, enabling ease of loading and subsequent unloading for further processing, the unloading being capable of accomplishment without engaging the interior of the tubular containers.

Another object of the invention is to provide a case of the type described and which is less expensive to manufacture by virtue of the simplified construction thereof.

Yet another object of the invention is to provide a case of the type described and which accommodates a greater number of tubular containers within a given internal volume than cases currently in use for similar purposes.

Still another object of the invention is to provide a case within which the tubular containers can be arranged in freely stacked rows, with the rows staggered for compact placement of the containers within the case, while enabling unloading without engaging the interior of the tubular containers.

A further object of the invention is to provide apparatus for unloading tubular containers from cases without engaging the interior of the tubular containers.

A still further object of the invention is to provide apparatus for unloading the tubular containers from a case in rows of containers pushed from the case, row by row.

Yet a further object of the invention is to provide apparatus for unloading tubular containers from cases in a row-by-row sequence at a level elevated relative to a selected delivery point so that delivery of the containers is facilitated by the descent of the containers to the delivery point.

An overall object of the invention is to provide a case of the type described which is especially suited for use in an apparatus of the type described so as to create an improved system for handling tubular containers which are fabricated at one location and transferred to another location for filling and closing.

The above objects, as well as still further objects and advantages, are attained by the present invention which may be described briefly as a system which employs apparatus for unloading tubular containers from incoming cases within which the tubular containers are arranged in freely stacked rows, each container having a longitudinal axis and each case having an access opening and a longitudinally opposite egress opening, the unloading being such that the rows emerge from a case through the egress opening thereof and are delivered serially to a selected delivery point, the apparatus comprising: a frame; an unloading station on the frame; holding means on the frame for holding a case at the unloading station with the case oriented such that the rows of tubular containers extend generally laterally and are stacked essentially altitudinally to include a first row located in an unloading location registered with the access opening and the egress opening of the case, and subsequent rows stacked beyond the first row and biased toward the unloading location, with the longitudinal axes of all of the tubular containers extending in a transverse direction; pusher means on the frame juxtaposed with the unloading station and including a pusher member movable in directions parallel to the transverse direction between a retracted position, wherein the pusher member is located outside the unloading station and adjacent the row of tubular containers located at the unloading location in the case held in the unloading station and in longitudinal alignment with the access opening and egress opening of the case, and an advanced position, wherein the pusher member is located inside the unloading station in place of the row of tubular containers at the unloading location, to complete a cycle of operation; a receiving station on the frame juxtaposed with the unloading station in position for receiving a row of tubular containers pushed out of the unloading station in response to advancement of the pusher member from the retracted position to the advanced position; delivery means on the frame at the receiving station for moving the tubular containers received at the receiving station laterally relative to the longitudinal axes thereof until the tubular containers arrive at the delivery point; and actuating means for actuating the pusher means through a plurality of cycles of operation to enable each subsequent row of tubular containers to be placed in the unloading location and to push each so-placed subsequent row of tubular containers from the case. The system further includes a case for holding tubular containers arranged in freely stacked rows capable of being unloaded from the case in serially delivered rows, the case comprising; a pair of first, opposite, spaced apart walls; a pair of second, opposite, spaced apart walls interconnecting the first pair of walls; a bottom wall generally perpendicular to the pairs of first and second walls and extending between the pairs of walls; a top opposite the bottom; a slot-like opening in the bottom wall adjacent one of the first walls and extending essentially from one to the other of the second walls; and means for providing an egress opening at the top, located opposite the slot-like opening, the egress opening extending essentially from one to the other of the second walls and extending between the first walls a distance at least great enough to enable a row of tubular containers, which row is parallel to the second walls, to pass through the egress opening.

The invention will be understood more fully, while still further objects and advantages will become apparent; in the following detailed description of a preferred embodiment of the invention illustrated in the accompanying drawing, in which.

Figure 1A:
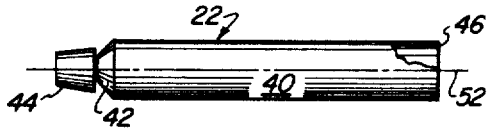
FIG. 1A is an enlarged plan view of a tubular container placed in the cases.

Referring now to the drawing, and especially to FIGS. 1 through 7 thereof, a system constructed in accordance with the invention includes an apparatus 20 for unloading tubular containers, shown in the form of collapsible tubes 22, from cases 24 within which the tubes 22 are carried. Tubes 22 have been fabricated at a remote location (not shown) and have been placed in cases 24 for storage and transport to the location illustrated in FIG. 1, wherein the tubes 22 are transferred from the cases 24 to a filling and closing machine, shown only diagrammatically at 26. Filling and closing machine 26 has an infeed chute 28 for receiving the tubes 22 aligned in a row extending along chute 28, and the object of the system of the invention is to deliver the tubes 22, in appropriate order and alignment, and in good condition, to a designated delivery point 30, dictated by the configuration of the filling and closing machine 26.

Figure 9:
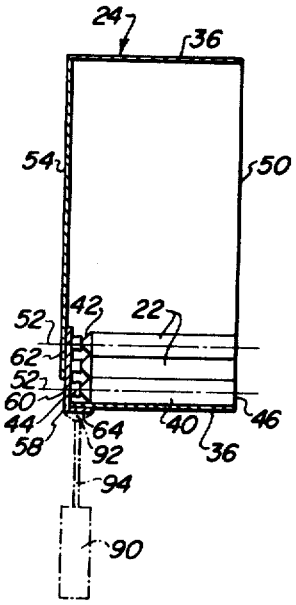
FIG. 9 is a cross-sectional view taken along line 9—9 of FIG. 8.
Figure 8:
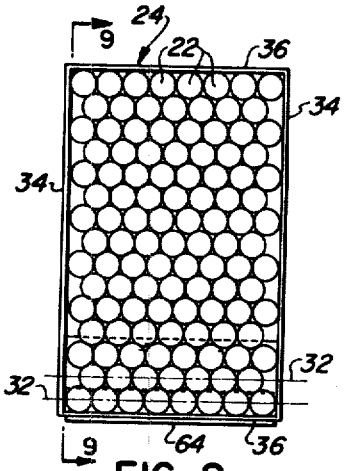
FIG. 8 is a top plan view of a loaded case of the system of the invention.
Figure 10:
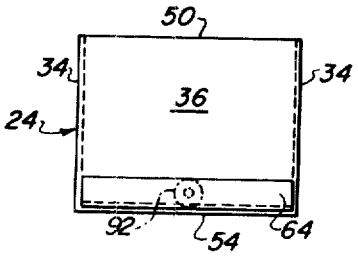
FIG. 10 is an elevational view of the case.
Figure 11:
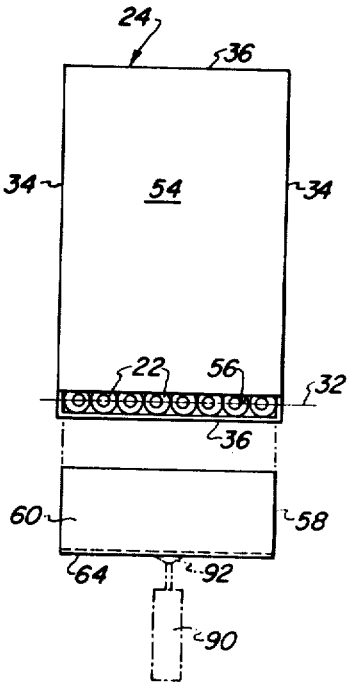
FIG. 11 is a bottom plan view, partially exploded, of the loaded case.

As best seen in FIGS. 8 through 11, each case 24 carries a plurality of tubes 22 arranged in freely stacked rows; that is, each row 32 of tubes 22 extends between first opposite spaced apart side walls 34 of the case 24 and the rows 32 are stacked one above the other, as viewed in FIGS. 8 and 9, between second opposite spaced apart side walls 36, without intermediate partitions.

In the illustrated embodiment, the tubes 22, which are best seen in FIG. 1A, are toothpaste tubes having a generally cylindrical tubular body 40 with an integral top 42 at one end thereof, and a removable cap 44 already affixed to the top 42. The tubular body 40 is open at the other end 46 thereof, through which open end 46 the tubes 22 are to be filled by the filling and closing machine 26, which also closes ends 46, subsequent to filling, as by crimping, in a now well-known manner.

Tubes 22 are loaded into case 24 through an open top 50 of the case. All of the tubes 22 are aligned with the longitudinal axes 52 thereof parallel with one another and perpendicular to the bottom wall 54 of the case. The caps 44 of the tubes 22 rest on the bottom wall 54, which is integral with side walls 34 and 36. As set forth above, the rows 32 of tubes 22 extend parallel to side walls 36 of the case 24. The tubes 22 in each row 32 abut one another for compact packing, and consecutive stacked rows 32 are staggered so that contiguous rows are nested for added conservation of space. The stacked rows of nested tubes creates a matrix of individually free tubes, within which matrix the tubes themselves aid in maintaining the desired arrangement wherein the rows 32 are parallel and all of the tube axes 52 are aligned generally perpendicular to the bottom wall 54 of the case 24. A slot-like opening 56 is provided in bottom wall 54 of case 24 for purposes which will be described more fully below. Opening 56 has a length which extends from one to the other of side walls 34, parallel to rows 32 of tubes 22, and generally coextensive with the lowermost or first row 32 located against the lower of side walls 36, as viewed in FIGS. 8, 9 and 11.

The width of opening 56, which extends in the direction toward the other or upper of side walls 36, is somewhat less than the diameter of a tube 22, or the height of a row 32, for reasons which will become apparent hereinafter. A closure 58 is placed over opening 56, not only for the purpose of closing the opening, but for reinforcing the bottom wall 54 along the length of the opening 56 by connecting the bottom wall with the adjacent lower side wall 36. Thus, closure 58 includes a leg 60 which extends along a portion of bottom wall 56 at 62. A flap 64 of the closure 58 extends along a portion of the outside of lower side wall 36 to complete the assembly.

Returning now to FIGS. 1 through 7, incoming cases 24 are delivered to apparatus 20 at a first level L. Each case 24 is then raised to a second level LL, above level L, where the case is unloaded to deliver tubes 22 to the designated delivery point 30, which lies at a third level intermediate first and second levels L and LL.

Apparatus 20 has a frame 70. An input station 72 is located on the frame 70 at level L and apparatus 20 includes an elevator 74 having a platform 76 movable between level L and level LL. Platform 76 is carried by slide blocks 78 which slide along vertical guide rods 80 in response to the actuation of an actuator in the form of an air cylinder 82 having a piston rod 84 which is coupled to the slide blocks 78 through a yoke assembly 86. As best seen in FIGS. 1 through 4, an incoming case 24 is placed on platform 76, at level L, oriented so that the lower side wall 36 rests upon the platform 76 with the bottom wall 54 of the case abutting a rear locator plate 88 affixed to the frame 70. Upon actuation of air cylinder 82, platform 76 will rise toward level LL.

Figure 1:
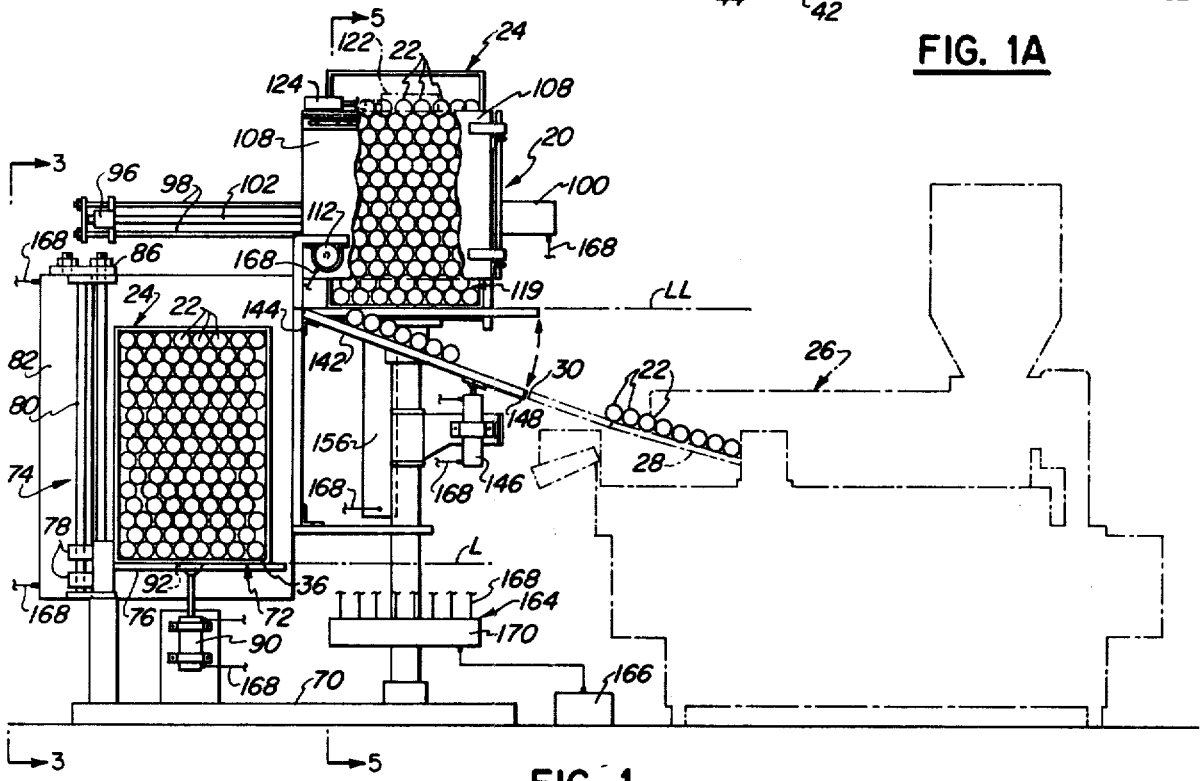
FIG. 1 is a partially diagrammatic, front elevational view of an apparatus shown unloading cases, the apparatus and cases being constructed in accordance with the system of the invention.
Figure 2:
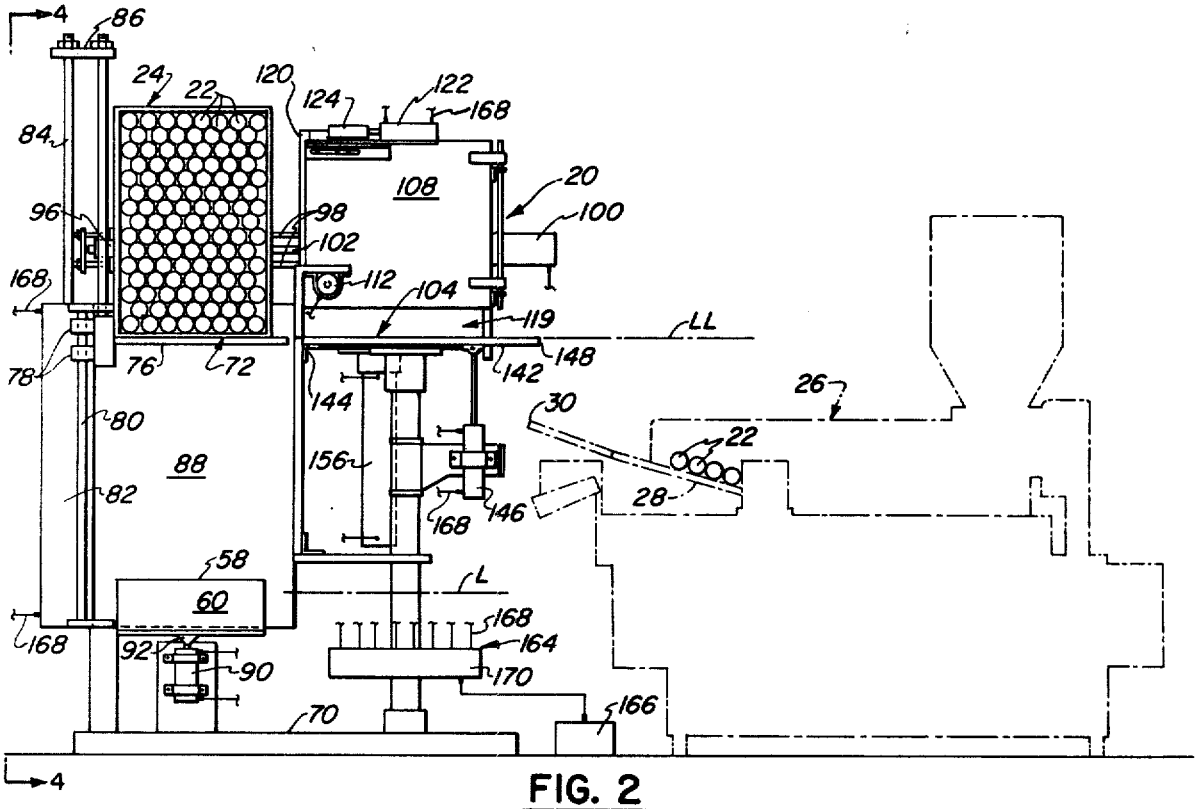
FIG. 2 is a view similar to FIG. 1, but with operating component parts in a different operating position.
Figure 3:
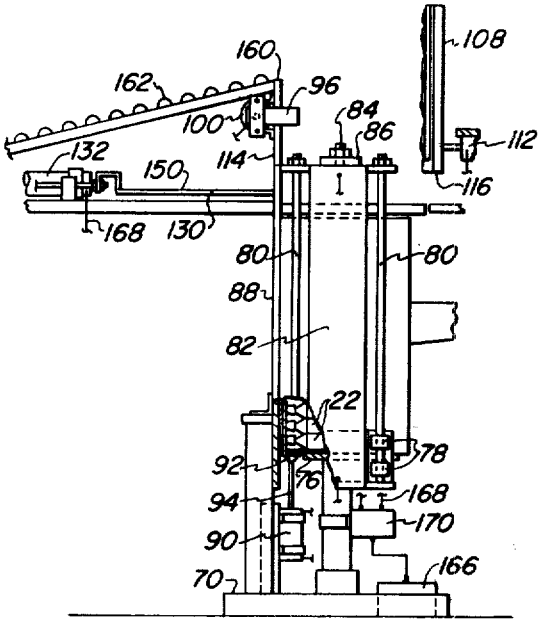
FIG. 3 is a fragmentary side elevational view taken along the direction of arrows 3 in FIG. 1.
Figure 4:
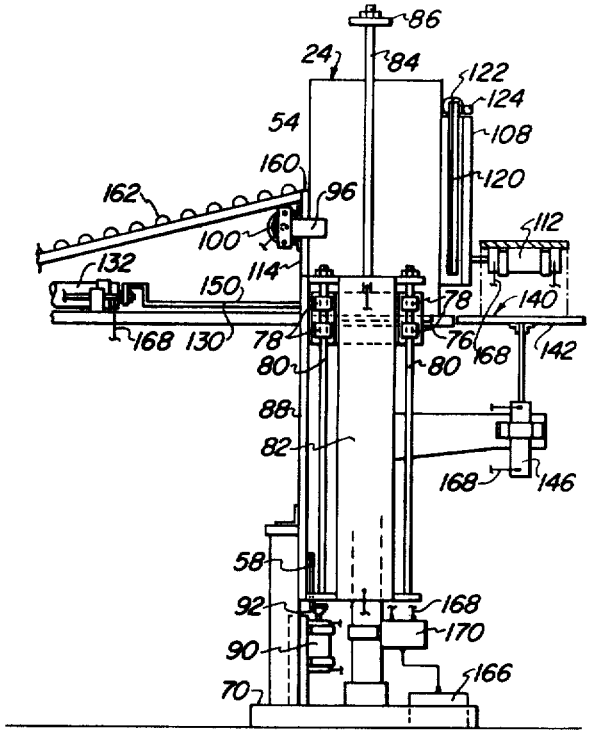
FIG. 4 is a side elevational view taken along the direction of arrows 4 in FIG. 2.

Just prior to upward movement of platform 76, an opening means is operated to open the slot-like opening 56 of case 24. Thus, a small air cylinder 90 is mounted upon frame 70 and carries a gripper in the form of suction cup 92 which is urged into gripping engagement with the flap 64 of closure 58, upon actuation of air cylinder 90, as seen in FIGS. 1 and 3, to extend the piston rod 94 of air cylinder 90. Upon retraction of piston rod 94, and the suction cup 92 carried thereon, the closure 58 will be withdrawn from the case 24, as seen in FIGS. 2 and 4, thereby opening the slot-like opening 56 of the case 24 as the case is moved to level LL. The closure 58 is discarded. Since the width of opening 56 is less than the diameter of each tube 22, the tubes 22 cannot pass through opening 56 and will be retained within case 24 even after closure 58 is removed and discarded.

When the platform 76 and case 24 reach level LL, a shuttle 96, which slides along horizontal guide rods 98 in response to actuation of another air cylinder 100 (see FIG. 7) mounted upon frame 70 and coupled to shuttle 96 by means of a piston rod 102, engages the case 24 on platform 76 and moves the case 24 laterally from the platform into an unloading station 104 on the frame 70 where the case 24 rests upon a table 106 and against a side plate 107 carried by frame 70. A holding means includes a gate 108 hinged at 110 to the frame 70 for swinging movement about a vertical axis in response to the actuation of a further air cylinder 112 so that upon the arrival of case 24 at the unloading station 104, gate 108 swings against the top 50 of case 24 and secures the case 24 between the gate 108 and a backing bar 114 against which the bottom wall 54 of case 24 rests. The lowermost edge 116 of gate 108 is spaced upwardly from the table 106 to clear the first or lowermost row 32 of tubes 22 so as to enable egress of that row through the open top 50 of case 24, as will be explained shortly. However, the gate 108 above lowermost edge 116 serves as a dam to retain the subsequent rows 32, stacked immediately above the lowermost row 32 of tubes 22. Likewise, backing bar 114 terminates at a lower edge 118 spaced above table 106 to expose the slot-like opening 56 in the bottom wall 54 of case 24 for access to the lowermost row 32, which lowermost row 32 now is located at an unloading location 119 within unloading station 104.

The holding means further includes a stop latch 120 carried by the gate 108 and actuated by an air cylinder 122 coupled to the latch 120 by means of a rack and pinion arrangement 124. Upon the arrival of the case 24 at the unloading station 104 and closing of the gate 108 against the top 50 of case 24, the latch 120 is rotated into engagement with the trialing side wall 34 of case 24 to secure the case in place at the unloading station 104. Latch 120 extends vertically along the greatest portion of trailing side wall 34 to retain that side wall against any tendency to bulge outward so that the matrix of tubes 22 remains undistorted.

Figure 5:
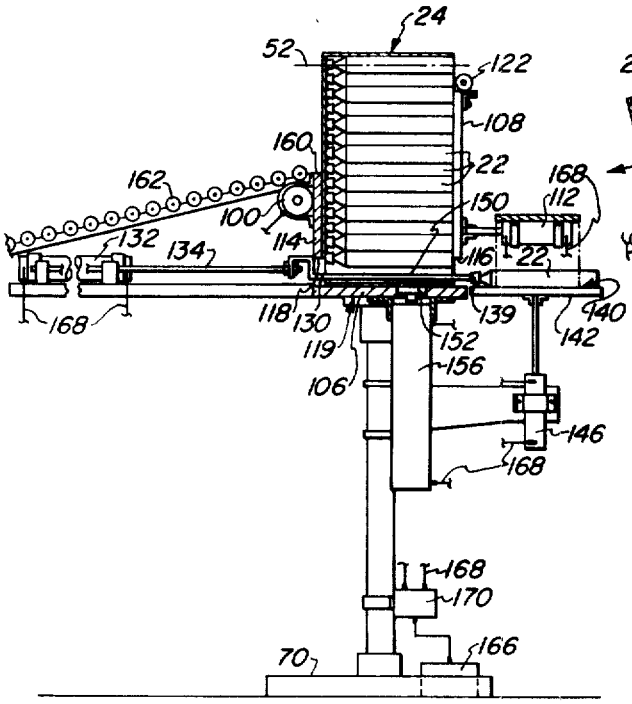
FIG. 5 is a side elevational, cross-sectional view of the apparatus taken along line 5—5 of FIG. 1.

Once the case 24 is captured and secured in the unloading station 104, the tubes 22 are unloaded one row 32 at a time, in row-by-row sequence, from unloading location 119, as follows. A pusher means is located adjacent the unloading station 104 and includes a pusher member 130 movable in transverse directions, parallel to the longitudinal axes 52 of the tubes 22 in a row 32, between a retracted position, wherein the pusher member 130 is located outside the unloading station 104, adjacent the lowermost row 32 of tubes 22 in the unloading location 119, and in longitudinal alignment with the access area beneath backing bar 114 and the egress area beneath gate 108, as seen in FIG. 4, and an advanced position, wherein the pusher member 130 is located inside the unloading station 104, at the unloading location 119, in place of the lowermost row 32 of tubes 22, as seen in FIG. 5. Pusher member 130 is coupled to an actuator in the form of an air cylinder 132 by means of the piston rod 134 of the air cylinder 132. A pair of transverse guide rods 136 are carried by the pusher member 130 and slide within guide blocks 138 affixed to frame 70 to confine the pusher member to movement along a fixed path of travel between the retracted and advanced positions, in response to actuation of air cylinder 132.

Pusher member 130 has a laterally extending forward edge 139 which, upon movement of the pusher member 130 from the retracted position to the advanced position, enters the slot-like opening 56 and engages the caps 44 of the tubes 22 in the lowermost row 32 to move the lowermost row of tubes out of the unloading location 119 and out of case 24 through the access opening at the top 50 of the case. It is noted that the pusher member 130 engages the exterior of the tubes 22 and thus unloads the tubes from the case 24 without engaging the interior surfaces of the tubes. In this manner, damage to the interior of the tube wall is precluded and a possible source of contamination of the tube interior is eliminated. Pusher member 130 is spaced upwardly from table 106 to clear the lower side wall 36 of the case 24 at the unloading station 104.

Figure 6:
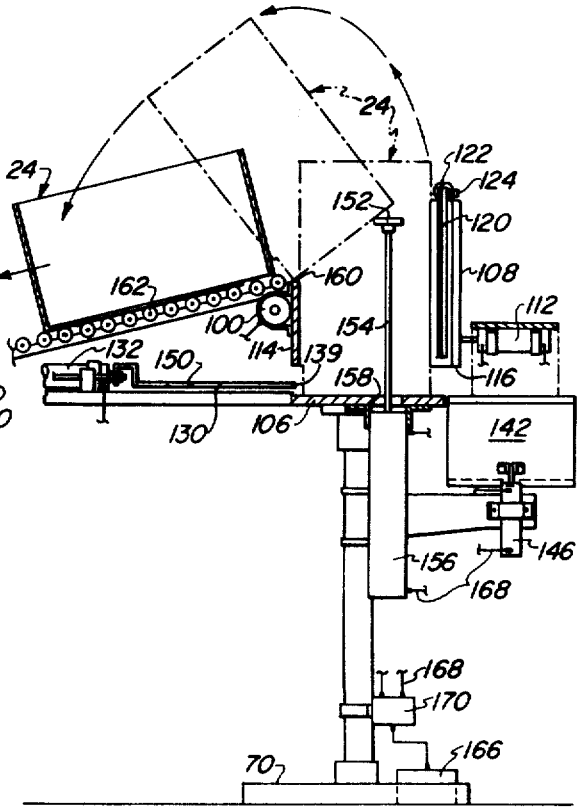
FIG. 6 is a view similar to FIG. 5, but with operating component parts in another operating position.
Figure 7:
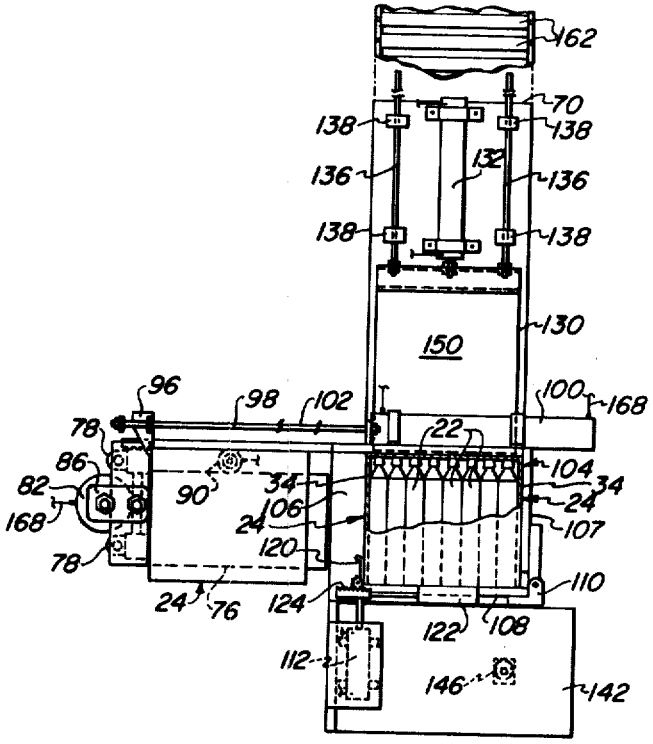
FIG. 7 is a top plan view, partially cut away, of the apparatus.

A receiving station 140 is located on frame 70 and is juxtaposed with the unloading station 104 so as to receive the row 32 of tubes 22 pushed from the unloading location 119 and the case 24 by the pusher member 130. A delivery means at the receiving station 140 includes a ramp 142 for supporting the pushed row 32 of tubes, as shown in FIGS. 2, 4 and 5. Ramp 142 is placed immediately in front of the table 106 so as to receive the pushed row 32 intact. Ramp 142 is hinged at 144 to frame 70 for movement between the horizontal position, shown in FIGS. 2 through 5, and an inclined or tilted position, as shown in FIGS. 1 and 6. An actuator in the form of an air cylinder 146 moves the ramp 142 between the horizontal and inclined positions. When the lowermost row 32 of tubes 22 is pushed transversely onto the ramp 142, the ramp is in the horizontal position to receive the row 32 intact. Then the ramp 142 is lowered, by actuation of the air cylinder 146, to the tilted position where the lower edge 148 of the ramp 142 is placed at the designated delivery point 30. The tubes 22 in the row 32 on ramp 142 will roll about their longitudinal axes 52 in a lateral direction down the ramp 142 to the delivery point 30 and beyond, onto the infeed chute 28 of the filling and closing machine 26 in the appropriate order and alignment, as seen in FIG. 1. Once the entire row 32 enters the filling and closing machine 26, the ramp 142 is returned to the horizontal receiving position.

Returning now to FIG. 5, when the pusher member 130 is in the advanced position, the subsequent rows 32 of tubes 22 remaining in the case 24 rest upon a platform 150 provided along the upper surface of the pusher member 130. Upon retraction of the pusher member 130 to the retracted position, the stacked subsequent rows 32 will drop downwardly, by virtue of the biasing force of gravity, until the next subsequent row 32 comes to rest upon the table 106 and thus becomes the lowermost row, located at the unloading location 119. The entire cycle of operation of the pusher member 130 and the ramp 142 is then repeated until all of the rows 32 are unloaded from the case 24 and delivered to the filling and closing machine 26 in row-by-row sequence and the case 24 becomes empty.

Turning now to FIG. 6, the empty case 24 is ejected from apparatus 20 by means of an ejector 152 carried by the piston rod 154 of an air cylinder 156 mounted on frame 70. During the unloading of the case 24, as described above, the ejector 152 is located within a recess 158 in table 106, beneath the lower side wall 36 of the case 24. When the empty case is to be ejected, gate 108 is swung away from the open top 50 of the case and then air cylinder 156 is actuated to raise the ejector 152 and thus raise the empty case 24. The ejector 152 is located somewhat forward of the center of gravity of the case so that the case is biased backward, against the backing bar 114, as the case 24 is lifted. As the case 24 progresses upwardly beyond the upper edge 160 of backing bar 114, the case 24 will tilt backwards, as shown in phantom in FIG. 6, and ultimately will drop onto a roller conveyor 162, as seen in full lines in FIG. 6. The roller conveyor 162 is inclined downwardly and directs the empty case 24 to a pick-up point outside the apparatus 20. The ejector 152 is retracted into recess 158 and another full case 24 is then positioned at the unloading station 104 for unloading the tubes 22 therein and transferring the tubes to the filling and closing machine 26.

A control system is shown schematically at 164 for controlling the supply of air from a source 166 of air under pressure to supply lines 168 which direct air to the various actuators described above. Limit switches (not shown) are located throughout apparatus 20 and serve in connection with a central controller 170 to control the cycle of operations described, in a manner well within the skill of those versed in the art of controls.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. Apparatus for unloading tubular containers from incoming cases within which the tubular containers are arranged in freely stacked rows, each container having a longitudinal axis and each case having an access opening and a longitudinally opposite egress opening, the unloading being such that the rows emerge from a case through the agress opening thereof and are delivered serially to a selected delivery point, said apparatus comprising:

a frame;

an unloading station on the frame;

holding means on the frame for holding a case at the unloading station with the case oriented such that the rows of tubular containers extend generally laterally and are stacked essentially altitudinally to include a first row located in an unloading location registered with the access opening and the egress opening of the case, and subsequent rows stacked beyond the first row and biased toward the unloading location, with the longitudinal axes of all of the tubular containers extending in a transverse direction;

pusher means on the frame juxtaposed with the unloading station and including a pusher member movable in directions parallel to the transverse direction between a retracted position, wherein the pusher member is located outside the unloading station and adjacent the row of tubular containers located at the unloading location in the case held in the unloading station and in longitudinal alignment with the access opening and egress opening of the case, and an advanced position, wherein the pusher member is located inside the unloading station in place of the row of tubular containers at the unloading location, to complete a cycle of operation;

a receiving station on the frame juxtaposed with the unloading station in position for receiving a row of tubular containers pushed out of the unloading station in response to advancement of the pusher member from the retracted position to the advanced position;

delivery means on the frame at the receiving station for moving the tubular containers received at the receiving station laterally relative to the longitudinal axes thereof until the tubular containers arrive at the delivery point; and actuating means for actuating the pusher means through a plurality of cycles of operation to enable each subsequent row of tubular containers to be placed in the unloading location and to push each so-placed subsequent row of tubular containers from the case.

2. The invention of claim 1 wherein the holding means holds the case oriented such that the rows of tubular containers extend horizontally and are stacked vertically so that the first row is a lowermost row and the subsequent rows are located above the first row and are biased downwardly by gravity.

3. The invention of claim 2 wherein the incoming cases are located at a first level, the unloading station is located at a second level above the first level, and the selected delivery point is located at a third level intermediate the first and second levels, and the delivery means includes a ramp for receiving each row of tubular containers at the second level and directing the tubular containers to the third level.

4. The invention of claim 3 wherein the ramp is movable between a receiving position, wherein the ramp is horizontal and is adjacent the unloading station at the second level for receiving the pushed row of tubular containers essentially intact at the second level, and a delivering position, wherein the ramp is tilted toward the delivery point to enable the row of tubular containers to roll, about the longitudinal axes thereof, from the second level toward the third level.

5. The invention of claim 2, 3 or 4 wherein the apparatus includes elevator means for raising each case from the first level to the second level.

6. The invention of claim 5 wherein the incoming cases each include a closure closing the access opening thereof and the apparatus includes opening means for manipulating the closure to open the access opening.

7. The invention of claim 6 wherein the opening means includes means for gripping the closure of a case, and means for withdrawing the closure from the access opening.

8. The invention of claim 1 wherein the pusher member includes a laterally extending edge engageable with the exterior of each of the tubular containers in the row at the unloading location, and the actuating means includes an actuator for moving the edge in transverse directions as the pusher member is moved between the retracted position and the advanced position.

9. The invention of claim 8 wherein the pusher member includes a platform for extending beneath the subsequent rows of tubular containers when the pusher member is in the advanced position.

10. The invention of claim 8 or 9 including a dam at the unloading station for location adjacent the egress opening of the case for confining within the case the subsequent rows of tubular containers while the first row of tubular containers is pushed from the case.

* * * * *